United States Patent [19]

Lewandowski et al.

[11] 4,437,034

[45] Mar. 13, 1984

[54] PARALLEL-WIRE GRID ASSEMBLY WITH METHOD AND APPARATUS FOR CONSTRUCTION THEREOF

[75] Inventors: Edward F. Lewandowski, Westmont; John Vrabec, South Holland, both of Ill.

[73] Assignee: The United States of America as represented by the United States Department of Energy, Washington, D.C.

[21] Appl. No.: 314,920

[22] Filed: Oct. 26, 1981

[51] Int. Cl.[3] ..... H01J 1/46; H01J 17/04; H01J 19/38; H01J 21/10

[52] U.S. Cl. ..... 313/348; 140/71 B; 313/349; 445/60

[58] Field of Search ..... 313/348, 349, 350; 29/25.14, 25.17

[56] References Cited

U.S. PATENT DOCUMENTS

| | | | |
|---|---|---|---|
| 2,851,628 | 9/1958 | Bongers | 313/348 |
| 2,861,211 | 11/1958 | Brown et al. | 313/348 |
| 3,212,169 | 10/1965 | Glaser et al. | 313/348 |
| 3,238,410 | 3/1966 | Beggs | 313/348 |
| 4,080,546 | 3/1978 | Steigerwald et al. | 313/348 |
| 4,150,319 | 4/1979 | Nowak et al. | 313/348 |
| 4,325,001 | 4/1982 | Heslin | 313/348 |

*Primary Examiner*—Saxfield Chatmon, Jr.
*Attorney, Agent, or Firm*—Paul A. Gottlieb; Bruce R. Mansfield; Michael F. Esposito

[57] ABSTRACT

Disclosed is a parallel wire grid and an apparatus and method for making the same. The grid consists of a generally coplanar array of parallel spaced-apart wires secured between metallic frame members by an electrically conductive epoxy.

The method consists of continuously winding a wire about a novel winding apparatus comprising a plurality of spaced-apart generally parallel spindles. Each spindle is threaded with a number of predeterminedly spaced-apart grooves which receive and accurately position the wire at predetermined positions along the spindle. Overlying frame members coated with electrically conductive epoxy are then placed on either side of the wire array and are drawn together. After the epoxy hardens, portions of the wire array lying outside the frame members are trimmed away.

1 Claim, 3 Drawing Figures

PARALLEL-WIRE GRID ASSEMBLY WITH METHOD AND APPARATUS FOR CONSTRUCTION THEREOF

CONTRACTUAL ORIGIN OF THE INVENTION

The U.S. Government has rights in this invention pursuant to Contract No. W-31-109-ENG-38 between the U.S. Department of Energy and Argonne National Laboratory.

BACKGROUND OF THE INVENTION

This invention relates to wire grids and methods for making the same. More particularly, this invention is directed to parallel-wire grids used in ionization chambers of the parallel-plate type. Such chambers have a grounded cathode which is coated with a radioactive material, and an anode to which a positive potential is applied. The chamber, which is pressurized with a gas such as argon, acts as a neutron detector in that neutron bombardment of the cathode releases fission fragments which ionize the gas. Ion products accelerated toward the anode create a measurable electrical current which is proportional to the frequency of ionization events occuring within the chamber. In order to control the migration of negative ions to the anode, a positively charged parallel-wire grid is positioned in the ion path between cathode and anode in a direction perpendicular thereto. Such grids consist of a number of spaced-apart parallel wires secured to a conductive frame. Prior art grids were typically formed by individually welding each wire of the grid to a frame member. This is usually a difficult, time-consuming process in that each wire added to the frame changes the forces applied to the frame, and often the configuration thereof, causing a change in the tension of previously secured wires. The spacing between the cathode and anode can be increased, and the chamber can be pressurized to higher level if, for a given transparency (ratio of total wire surface area to inter-wire spacing), the interwire spacing could be reduced. This, in turn, would require an even greater accuracy in uniformly spacing adjacent wires during assembly.

It is therefore an object of the present invention to provide an inexpensive parallel-wire grid, having improved accuracy of wire spacing.

It is a further object of the present invention to provide a simplified method for making a parallel wire grid.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

These and other objects of the present invention are provided by a grid comprising an array of spaced-apart wires suspended across a frame member. The array is preferably comprised of parallel, equally spaced wires arranged to lie in a flat plane. The frame includes two overlying mating halves joined together by an electrically conductive epoxy adhesive. End portions of the wires of the array are received between frame halves and are secured thereto with the epoxy adhesive.

The method for constructing the grid includes use of a novel winding assembly about which a single wire is wound. The winding assembly preferably comprises a plurality of generally parallel, spaced-apart spindles secured to a rotatably mounted end plate. Each spindle has a plurality of predeterminedly spaced-apart threads or the like index means which receive and thereby locate turns of the wire at desired predetermined fixed positions along the spindle. The indexing means of each spindle are aligned relative to each other such that the turns of a wire continuously wound about the core are arranged in a parallel, spaced-apart, substantially coplanar relationship. The two overlying halves of the frame each include opposing faces which are coated with an electrically conductive epoxy adhesive. The halves of the frame are then positioned on opposing sides of the wire array, between two adjacent spindles. Opposing faces of the frame halves are then drawn together so as to secure the wire array therebetween, and a bond between the frame halves and wire array is formed by the epoxy adhesive. Finally, wire portions lying outside the frame are trimmed away.

DESCRIPTION OF THE PREFERRED EMBODIMENT

Figure 1:
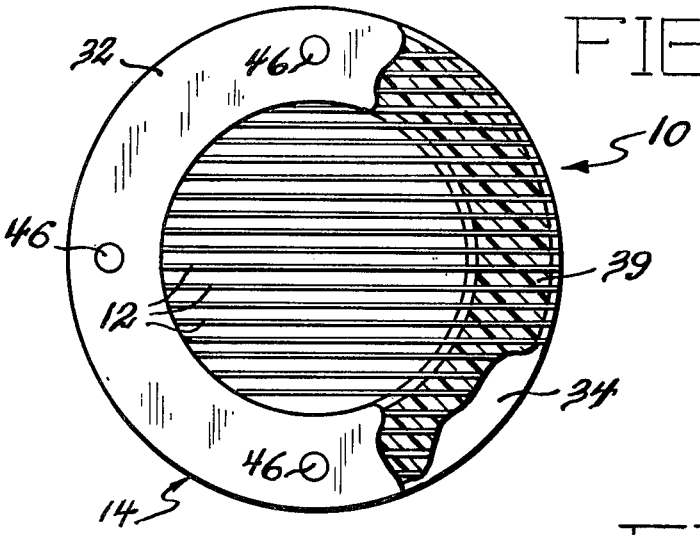
FIG. 1 shows a grid constructed according to the invention.

Referring now to the drawings and especially to FIG. 1, a completely assembled grid 10 according to the invention is shown comprising an array of parallel uniformly spaced-apart wires 12 mounted in a conductive frame 14. Each wire is electrically connected to frame 14 to form an electrical grid of the type used to create an electric field for control of a charged particle flow in a space-charged region.

Figure 2:
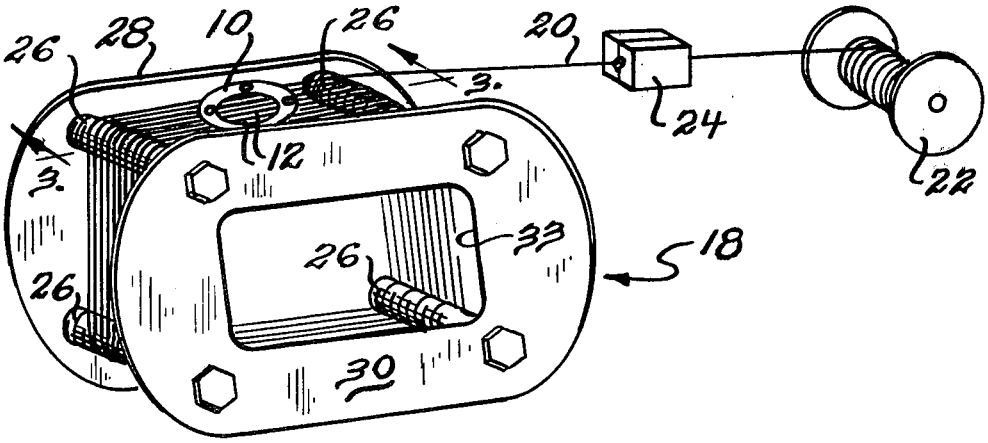
FIG. 2 is a perspective view of the winding assembly according to the invention.

Construction of the grid will now be described with reference to FIG. 2 in which a winding assembly 18 receives wire 20 from supply spool 22 at a constant tension provided by tension device 24. Assembly 18 comprises a plurality of generally parallel-spaced apart spindles 26 which are supported at either end by rotatably mounted end plates 28, 30. Each spindle contains indexing means or threads which receive wire 20, holding that wire in fixed position at points along the spindle during the coil winding operation. As wire 20 is wound over spindles 26, a single coil is formed in a continuous operation. The formation of a single coil, however, is a feature of a simplified construction made possible by the invention, and is not significant to the design of a grid produced thereby. A central aperture 33 in plate 30 accommodates entry of a frame 14 therethrough. In the preferred embodiment, spindles 26 resemble commercially available threaded rod or bolts, whose pitch accurately determines the spacing between adjacent turns of wire 20. In this embodiment, the threads serve as indexing means formed in the surface of each spindle which contacts wire 20, so as to provide accurate spacing between parallel-arranged wires.

Although, in the preferred embodiment, pairs of adjacent spindles 26, which lie in the same flat plane, are generally parallel to each other and are perpendicular to plates 28, 30, it will be appreciated that spindles 26 can be oriented in other ways so as to give rise to wire arrays of varying planar configurations. The term "planar", as used herein, denotes curved, as well as flat, mathematical "surfaces". For example, the spindles may be arranged to lie in a flat plane, but in a non-parallel fashion such that the resulting wire array has a graded spacing with the smallest spacing occurring near the spindle ends positioned closest together. Also, the spindles could be arranged to lie in a curved plane, i.e. along a curved "surface" as that term is used in its mathematical sense. In this latter arrangement, the frame must be configured to also lie along the same curved surface. Further, the spacing of index means of adjacent spindles need not be identical. For example, if one spindle has index means spaced very closely together, relative to the other spindle, the resulting wire array will "fan out" from the one spindle. These alternative array constructions can be used to establish particularly configured electric fields not otherwise obtainable by using flat planar arrays of wires.

Figure 3:
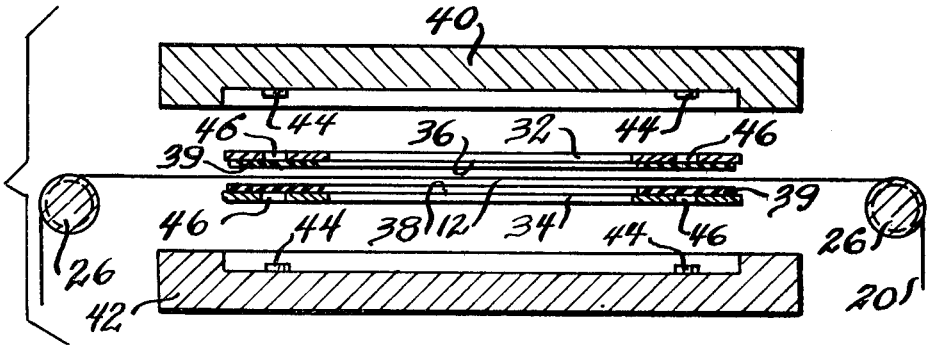
FIG. 3 is a partial cross-sectional view, taken along the lines 3—3 of FIG. 2.

Referring to FIG. 3, frame 14 comprises two mating overlying halves or grid plates 32, 34 formed of a metal or other electrically conductive material. Plates 32, 34 are arranged in opposing relationship on either side of an array of wires 12 extending between spindles 26. The opposing faces 36, 38 of plates 32, 34 are coated with an electrically conductive epoxy or the like adhesive 39 and are drawn together to retain wires 20 therebetween. The epoxy adhesive forms a mechanical and electrical bond between wires 20 and the plates 32, 34 of frame 14. A clamping fixture comprised of clamp members 40, 42 (not shown in FIG. 2) is employed to maintain plates 32, 34 in secure engagement with each other while the epoxy adhesive hardens. Plate 34 and clamp member 42 are inserted through the central aperture 33 formed in end plate 30. Alignment pins 44, formed in clamp members 40, 42, are received in apertures 46 of grid plates 32, 34. The arrangement of pins 44 and apertures 46 provides relative alignment between grid plates 32, 34, obviating the need for further fastening or aligning means. After the epoxy adhesive hardens, all portions of wire grid 12 lying outside grid plates 32, 34 are trimmed away, leaving the finished product of FIG. 1.

An example of the grid according to the invention, constructed at Argonne National Laboratory, had stainless steel grid plates whose O.D. and I.D. were 4.75 inches and 3.25 inches respectively. The spindles 26 comprise threaded rods having a pitch of 25 threads per inch, to give a 40 mil spacing between adjacent wires of the grid. The wire used was 5 mil diameter stainless steel wire, and the epoxy adhesive was Hysol K-20 silver epoxy. Four spindles were provided to accommodate the simultaneous construction of four parallel wire grids.

The embodiments of the invention in which an exclusive property or privilege is claimed are defined as follows:

1. A winding assembly for use in constructing a plurality of parallel-wire grids wherein arrays of substantially coplanar spaced-apart parallel wires are retained between overlying first and second mating frame members by an electrically conductive adhesive, the arrays being formed by continuously winding a wire along a predetermined path, the winding assembly comprising;

a plurality of spaced-apart spindles each having opposing ends, at least one outer surface for contacting said wire, and a plurality of predeterminedly spaced index means on said one surface for receiving said wire, said index means comprising a single continuous substantially helical groove formed on the outer surfaces of said spindles;

first and second spaced-apart walls, said opposing ends of said first and said second spindles joined to said first and said second walls respectively, so as to be suspended therebetween in a predetermined spaced-apart relationship;

means for rotatably mounting said first wall to rotate said assembly, thereby winding said wire about said plurality of spindles; and aperture means located in said second wall for introduction of one of said first and said second mating frame members to interior portions of said wire array which are enclosed by the continuous winding of said wire about said plurality of said spindles.

* * * * *